US006700498B1

(12) United States Patent
Jeske et al.

(10) Patent No.: US 6,700,498 B1
(45) **Date of Patent: *Mar. 2, 2004**

(54) SYSTEM AND METHOD FOR DETERMINING THE ENVIRONMENTAL CONFIGURATION OF TELECOMMUNICATIONS EQUIPMENT

(75) Inventors: Richard Jeske, Georgetown, TX (US); Patrick E. Jackson, Austin, TX (US); Yen Teresa Nguyen, Austin, TX (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/273,955

(22) Filed: Oct. 18, 2002

Related U.S. Application Data

(63) Continuation of application No. 09/939,088, filed on Aug. 24, 2001, now Pat. No. 6,469,630.

(51) Int. Cl.[7] ..... G08B 21/00

(52) U.S. Cl. ..... 340/635; 340/825.36; 340/7.29; 370/254

(58) Field of Search ..... 340/635, 3.43, 340/825.36, 7.29, 511, 588, 589; 370/254; 374/141, 142, 144

(56) References Cited

U.S. PATENT DOCUMENTS

| | | | | | |
|---|---|---|---|---|---|
| 4,327,397 | A | * | 4/1982 | McCleery | 361/90 |
| 4,750,136 | A | | 6/1988 | Arpin et al. | 364/514 |
| 4,864,283 | A | * | 9/1989 | Seto | 340/584 |
| 5,115,225 | A | * | 5/1992 | Dao et al. | 340/584 |
| 5,355,121 | A | * | 10/1994 | Naito et al. | 340/584 |
| 5,732,215 | A | * | 3/1998 | Boutaghou et al. | 395/200.13 |
| 5,796,933 | A | | 8/1998 | Aitoniemi | 395/180 |
| 6,012,152 | A | | 1/2000 | Douik et al. | 714/26 |
| 6,359,565 | B1 | | 3/2002 | Pedoeem et al. | 340/584 |

* cited by examiner

*Primary Examiner*—Daniel J. Wu
*Assistant Examiner*—Phung Nguyen
(74) *Attorney, Agent, or Firm*—Baker Botts L.L.P.

(57) ABSTRACT

A system and method determines the environmental configuration of telecommunications equipment having interchangeable components to provide an alarm if an improper environmental configuration exists. A configuration engine associated with the network management system of the telecommunications equipment determines the environmental rating of components added to or removed from the telecommunications equipment by querying flash memory associated with the component. If components designed for controlled environmental conditions and components designed for uncontrolled environmental conditions are both present in the telecommunications equipment, then component engine 30 sets the alarm to alert the user of an improper environmental configuration.

33 Claims, 1 Drawing Sheet

SYSTEM AND METHOD FOR DETERMINING THE ENVIRONMENTAL CONFIGURATION OF TELECOMMUNICATIONS EQUIPMENT

RELATED APPLICATION

This application is a continuation of U.S. patent application Ser. No. 09/939,088 filed Aug. 24, 2001, now U.S. Pat. No. 6,469,630 and entitled "System and Method for Determining the Environmental Configuration of Telecommunications Equipment".

TECHNICAL FIELD

This invention relates generally to telecommunications equipment, and more specifically relates to a system and method for determining the environmental configuration of telecommunications equipment.

BACKGROUND OF THE INVENTION

Telecommunications equipment is deployed and operates in many different environmental conditions, such as various temperature ranges and in the presence of different types and quantities of contaminants. Telecommunications equipment is typically classified according to the type of environmental conditions that the equipment is designed to handle. One common classification is a classification for commercial environments that maintain controlled environmental conditions, such as narrow temperature ranges and reduced presence of contaminants. Telecommunications equipment having a commercial classification is thus generally installed and operated in controlled environmental conditions, such as temperature controlled central office facilities. Another common classification for telecommunications equipment is operation in an industrial environment. Equipment designed to operate in an industrial environment typically faces uncontrolled environmental conditions such as the outdoor temperature ranges experienced in the geographic location at which the telecommunications equipment is deployed. For instance, a digital subscriber line access multiplexer deployed at a digital loop carrier may experience extremely high summer time temperatures and extremely low winter temperatures.

Although telecommunications equipment having uncontrolled or outside plant classifications is generally less likely to fail due to extreme environmental conditions, such equipment is also typically much more expensive to manufacture. Due to this cost difference, telecommunications equipment used in both controlled and uncontrolled environments is normally manufactured and sold as different systems even if they perform similar functions. For example, digital subscriber line access multiplexers (DSLAM) are deployed both in controlled central office environments and uncontrolled distributed locations so that customer end points are able to interface with the central office through digital subscriber line (DSL) connections. DSLAMs are typically designed as modular systems with interchangeable components to provide scalable service. To reduce the cost and complexity of stocking the components, some of the less complex components are used in both DSLAMs having controlled and uncontrolled environmental ratings. For instance, a chassis backplane is an interchangeable component that offers little cost savings if designed separately for controlled and uncontrolled environments and is thus typically a component designed in a singular manner for use in both environments.

One difficulty with the use of interchangeable components that have controlled, uncontrolled and both environmental ratings is that telecommunications equipment may be deployed with improper environmental configurations. For instance, a component having an uncontrolled rating is generally more expensive than a component having a controlled rating so that the use of components having an uncontrolled environmental rating in telecommunications equipment deployed in a controlled environment creates an unnecessary expense. Further, the use of components having a controlled environmental rating in telecommunications equipment deployed in an uncontrolled environment may result in premature failure of the equipment and interruptions in telecommunications service. Detecting an improper environmental configuration is especially difficult when some of the interchangeable components are designed for use in both controlled and uncontrolled environments.

SUMMARY OF THE INVENTION

Therefore a need has arisen for a system and method which determines whether telecommunications equipment is configured or manufactured with a proper environmental configuration.

A further need has arisen for a system and method which determines the compatibility of components inserted in a modular telecommunications system with the anticipated environmental conditions in which the telecommunications system will operate.

In accordance with the present invention, a system and method is provided that substantially eliminates disadvantages and problems associated with previously developed systems and methods for determining the environmental configuration of telecommunications equipment. A component engine associated with the telecommunications equipment determines the environmental rating of components added to or removed from the equipment and sets an alarm if an improper environmental configuration exists.

More specifically, the telecommunications equipment accepts plural modular and interchangeable components that perform telecommunications functions. For instance, a DSLAM has a chassis backplane with slots to accept modular components such as daughter boards, line cards, network cards and optical interfaces. The components have flash memory that stores an environmental rating, such a controlled environmental rating or an uncontrolled environmental rating. Components with a controlled environmental rating are designed to operate in controlled environmental conditions such as a central office, and components with an uncontrolled environmental rating are designed to operate in uncontrolled environmental conditions such as the outdoors. Components that do not store an environmental rating are assigned a rating of both uncontrolled and controlled that is acceptable for use in both uncontrolled and controlled environmental conditions.

The component engine reads the environmental rating from the flash memory. If a component lacks flash memory or does not have a rating stored in its flash memory, then the component engine assigns a "both" rating to those components that do not store a rating. As components are added to or removed from the DSLAM, the component engine maintains a list of components and their ratings in list memory that is associated with the DSLAM's network management system. Alternatively, the flash memory stores the temperature ranges of a component and the component engine to determines the components temperature rating. In this embodiment, the component engine may track the overall temperature range of the system, resulting in an operating temperature range output for the telecommunications equipment.

An alarm is set to indicate an improper environmental configuration if the list memory includes at least one component having a controlled rating and one component having an uncontrolled rating. An alarm interface provides feedback to technicians so that a technician is able to identify the environmental rating of the components. If a component is removed from the DSLAM resulting in resolution of the alarm condition, such as a component with a controlled rating is removed leaving only components with uncontrolled and both ratings, then the alarm clears. In one embodiment, the telecommunications equipment is preconfigured with at least one component of a desired rating so that the component engine is able to check added components against the preconfigured rating and set an alarm if a component with a different rating is added.

The present invention provides a number of important technical advantages. One example of an important technical advantage is that the alarm provides automated warning at field locations if a technician creates an improper environmental configuration by changing the components within telecommunications equipment. The alarm reduces the risk of telecommunications equipment failure that might otherwise result if, for instance, a component having a controlled rating is mistakenly used in an uncontrolled environment. The alarm also reduces the risk that more expensive components designed for uncontrolled environments will be used in controlled environments, unnecessarily increasing the cost of the telecommunications equipment.

Another example of an important technical advantage of the present invention is that telecommunications equipment designed only for either a controlled or an uncontrolled environment is more easily converted to selectively operate in both environments by replacing selected components with interchangeable components having a desired environmental rating. For instance, telecommunications equipment designed to operate in a controlled central office environment may be upgraded to operate in uncontrolled outdoors environments by exchanging modules likely to fail in uncontrolled environments with interchangeable modules rated to operate in uncontrolled environments. The component engine is uploaded to operate on the network management system of the telecommunications equipment with minimal expense and complexity to substantially reduce the risk that the interchangeable components will be incorrectly loaded onto the telecommunications equipment.

BRIEF DESCRIPTION OF THE DRAWINGS

A more complete understanding of the present invention and advantages thereof may be acquired by referring to the following description taken in conjunction with the accompanying drawings, in which like reference numbers indicate like features, and wherein.

DETAILED DESCRIPTION OF THE INVENTION

Preferred embodiments of the present invention are illustrated in the figures, like numerals being used to refer to like and corresponding parts of the various drawings.

On a per-component basis, the cost savings of an uncontrolled environment rating for a component over its controlled environment component equivalent may or may not be significant enough to justify the separate design, manufacturing and inventory costs of maintaining different components. If the cost savings is not substantial enough to justify the interchangeable components with different ratings, then the component is designed to operate in both environments, typically by achieving the more stringent uncontrolled environmental rating. If the cost savings is substantial enough to justify interchangeable components with different environmental ratings then a component having a controlled rating is separately designed, manufactured and stocked from an interchangeable component having an uncontrolled rating.

Components having the uncontrolled rating are typically more expensive and thus is typically used in telecommunications equipment deployed in uncontrolled environmental conditions, such as the outdoors. In contrast, components having a controlled rating will typically fail if deployed in uncontrolled environmental conditions. For example, a chassis backplane is generally a less expensive component easily adapted for use in both controlled and uncontrolled environmental conditions. However, components that include many logical devices, such as motherboards and network cards, generally have a substantial cost associated with designs for uncontrolled environmental conditions compared with designs for controlled environmental conditions. Thus, it is generally economical to maintain and use these types of components as having separate environmental ratings.

In order to achieve the cost savings of having interchangeable components with controlled and uncontrolled ratings, the components must be compatible with common components that are rated for both controlled and uncontrolled environments. Thus, detection of improper environmental configurations presents a problem, especially if common component reference points, such as the chassis backplane are rated for both controlled and uncontrolled environmental conditions. For instance, if the chassis backplane is rated for both controlled and uncontrolled environmental conditions, then the addition of a controlled component or an uncontrolled component will not result in an improper environmental configuration unless both are added to the system.

Figure 1:
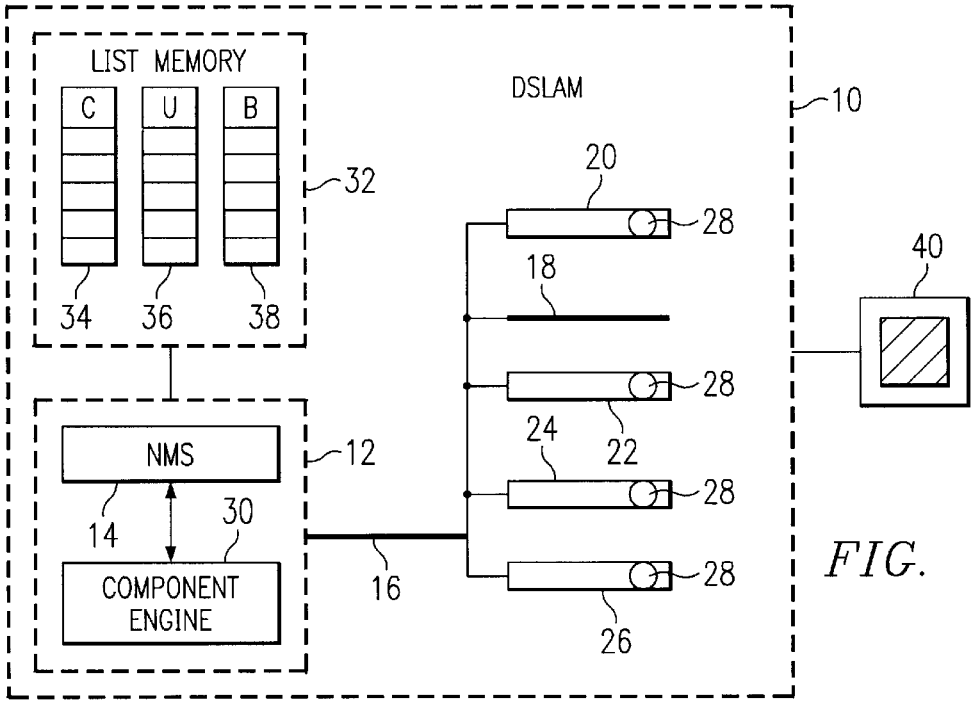
FIG. 1 depicts a block diagram of a DSLAM configured to detect its environmental configuration.

Referring now to FIG. 1, a block diagram depicts telecommunications equipment having interchangeable components that operate in controlled or uncontrolled environments. One example of such telecommunications equipment is a DSLAM which is often designed for use in both central office locations and distributed outdoor locations. DSLAM 10 includes a motherboard 12 that has hardware and software to support a network management system 14 which interfaces with components through a backplane bus 16. Backplane bus 16 is typically a relatively simple component that is rated for both controlled and uncontrolled environments. Motherboard 12 generally includes logical units that are sensitive to environmental conditions so that motherboard 12 generally has either a controlled rating or an uncontrolled rating. Network management system 14 however is typically driven by software components compatible with motherboards having either a controlled or uncontrolled rating. In alternative embodiments, components may be configured in a number of ways, such as integrating components like the optical interface and network interface with the motherboard. The system of FIG. 1 is an example for illustrative purposes.

Backplane bus 16 provides an interface between motherboard 12 and plural slots 18. Slots 18 accept cards that communicate with motherboard 12 to provide telecommunications functions. For instance, a daughterboard card 20 provides additional logic, a line card 22 provides an external interface for DSL connections, a network card 24 coordinates network activity, and an optical interface card 26 provides an optical interface to other networks, such as an OC3 connection to a regional operating center. The cards inserted in slots 18 cooperate with motherboard 12 and network management system 14 to provide telecommunications services between DSL end users and other locations, such as the internet. It should be understood that, although the present invention is described with respect to a DSLAM, other telecommunications equipment with similar architectures use interchangeable components having different environmental ratings and that such telecommunications equipment falls within the scope of the present invention.

A component engine 30 associated with motherboard 12 and interfaced with network management system 14 determines the environmental rating of components associated with DSLAM 10 by reading each component's rating from flash memory such as EEPROM 28 associated with each component. For instance, when a line card 22 is added to DSLAM 10, component engine 30 queries the EEPROM 28 associated with line card 22 to determine if the line card has a controlled rating or an uncontrolled rating. If the rating in the EEPROM 28 is controlled, then component engine 30 cooperates with network management system 14 to add the line card to list memory 32 in the controlled list 34. If line card 22 has an uncontrolled rating, component engine 30 adds the line card to the list memory 32 in the uncontrolled component list 36. If no rating is stored in the EEPROM 28, or no EEPROM 28 is found, then component engine 30 includes line card 22 in the both list 38 of list memory 32. As components are removed from DSLAM 10, component engine 30 removes the component from its appropriate list of list memory 32. In one alternative embodiment, both list 38 is not separately maintained so that components not found on controlled list 34 and uncontrolled list 36 are assumed to have a both rating.

When a component is added or removed from DSLAM 10, component engine 30 compares the components in list memory 32 to determine if an improper environmental configuration exists. For instance, if DSLAM 10 includes a component with a controlled environmental rating and a component with an uncontrolled environmental rating, then an improper environmental configuration exists. If an improper environmental configuration exists, component engine 30 sends network management system 14 an error message and outputs an alarm to alarm interface 40. A technician may use alarm interface 40 to query the identity and rating of the interchangeable components to isolate and correct the improper environmental configuration.

Figure 2:
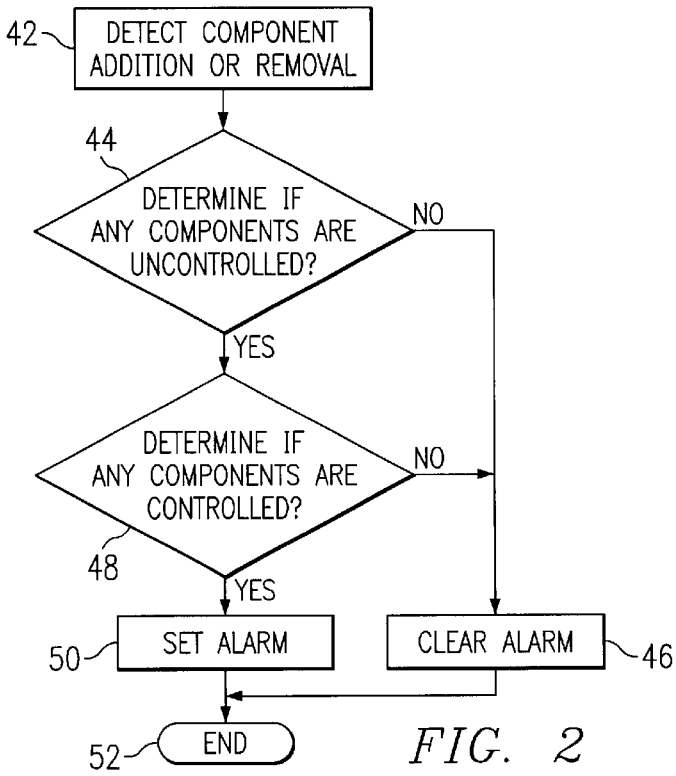
FIG. 2 depicts a flow diagram of steps for determining the environmental configuration of telecommunications equipment.

Referring now to FIG. 2, a flow diagram depicts the steps taken by component engine 30 to determine the environmental configuration of DSLAM 10. At step 42, component engine 30 detects the addition to or removal from DSLAM 10 of interchangeable components. For instance, if a card is inserted into slot 18, component engine 30 queries the card's flash memory to determine the environmental rating of the card and add the card to the appropriate list of list memory 32. If a card is removed from slot 18, component engine 30 removes the card's identity from list memory 32.

At step 44, component engine 30 determines if any components have an uncontrolled environmental rating. This determination is a query to list memory 32 for components listed in uncontrolled list 36. If no components are listed in uncontrolled list 36 then component engine 30 clears any alarms at step 46. If components are listed in uncontrolled list 36, then component engine 30 proceeds to step 48 to determine if any components are controlled. If any components are controlled then an improper environmental configuration exists and the alarm is set at step 50. If no components are controlled at step 48, then the alarm is cleared at step 46 and the process ends at step 52.

Component engine 30 represents a relatively simple software module that is easily interfaced with network management system 14. Thus, existing systems that are configured solely either for controlled or uncontrolled environments are easily upgraded to adapt into systems that accept interchangeable components with different environmental ratings by upgrading the network management system with a component engine.

Although the present invention has been described in detail, it should be understood that various changes, substitutions and alterations can be made hereto without departing from the spirit and scope of the invention as defined by the appending claims.

What is claimed is:

1. A method for determining an environmental configuration of a telecommunications system, comprising:

maintaining ratings for each of a plurality of components in a telecommunications system, each rating comprising one of the following:

a controlled rating indicating that the component is intended for use in a controlled environment;

an uncontrolled rating indicating that the component is intended for use in an uncontrolled environment; or a both rating indicating the component is intended for use in either the controlled environment or the uncontrolled environment;

determining that an improper environmental configuration exists if the telecommunications system includes at least one component with a controlled rating and at least one other component with an uncontrolled rating; and setting an alarm if the improper environmental configuration exists.

2. The method of claim 1, further comprising:

detecting addition of a new component to the telecommunications system; and in response to detecting the addition of the new component, determining a rating for the new component.

3. The method of claim 1, further comprising:

detecting removal of one of the components of the telecommunications system;

re-determining whether the improper environmental configuration exists; and clearing the alarm if the improper environmental configuration no longer exists.

4. The method of claim 1, wherein:

the rating of each component is stored in a flash memory associated with the component; and the step of determining a rating comprises downloading the rating from the component.

5. The method of claim 4, wherein the step of determining the rating further comprises assigning a both rating to the component if the component does not have an associated flash memory.

6. The method of claim 1, wherein:

the telecommunications system comprises a chassis backplane having a both rating; and the components are coupled to the chassis backplane.

7. The method of claim 1, wherein:

the ratings are associated with a capability for operations in predetermined temperature environments;

the controlled environment comprises an indoor environment; and the uncontrolled environment comprises an outdoor environment.

8. A system, comprising:

a component engine operable to:

maintain a rating for each component of a telecommunications system comprising a plurality of components, each rating comprising one of the following:

a controlled rating indicating that the component is intended for use in a controlled environment;

an uncontrolled rating indicating that the component is intended for use in an uncontrolled environment; or a both rating indicating the component is intended for use in either the controlled environment or the uncontrolled environment; and determine whether an improper environmental configuration exists such that the telecommunications system includes at least one component with a controlled rating and at least one other component with an uncontrolled rating;

a network management system interfaced with the component engine operable to set an alarm condition in response to the component engine detecting that the improper environmental configuration exists; and an alarm operable to provide notice that the improper environmental condition exists if the component engine determines that the improper environment condition exists.

9. The system of claim 8, wherein the component engine is further operable to:

detect addition of a new component to the telecommunications system; and in response to detecting the addition of the new component, determine a rating for the new component and re-determine whether the improper environmental configuration exists.

10. The system of claim 9, wherein the component engine determines the rating by performing the following steps:

downloading a rating from a flash memory of the new component; and if the component has no flash memory, assigning a both rating to the new component.

11. The system of claim 8, wherein:

the component engine is further operable to:

detect removal of one of the components from the telecommunications system; and delete the rating of the removed component from the ratings maintained by the component engine and re-determine whether the improper environmental configuration exists; and the network management system is operable to clear the alarm condition in response to the component engine determining that the improper environmental configuration no longer exists.

12. The system of claim 8, wherein:

the ratings are associated with a capability for operations in predetermined temperature environments;

the controlled environment comprises an indoor environment; and the uncontrolled environment comprises an outdoor environment.

13. The system of claim 8, wherein:

the default rating for components is the both rating; and maintaining a both rating for a component comprises determining that the component does not have either the controlled rating or the uncontrolled rating.

14. A method for determining the environmental configuration of a telecommunications system, comprising:

maintaining a temperature range for each component of a telecommunications system, the temperature range indicating temperature conditions in which the component is suitable for operation;

determining an overall temperature range for the telecommunications system based on the temperature ratings of the components; and setting an alarm if there is no range of operating temperatures that falls within the temperature ranges of all of the components of the telecommunications system.

15. The method of claim 14, further comprising outputting the overall temperature range to a user.

16. The method of claim 14, further comprising:

detecting addition of a new component to the telecommunications system; and in response to detecting the addition of the new component, determining a temperature range for the new component.

17. The method of claim 14, further comprising:

detecting removal of one of the components of the telecommunications system;

determining whether there is any range of operating temperatures that falls within the temperature ranges of all remaining components of the telecommunications system; and clearing the alarm if there is a range of operating temperatures that falls within the temperature ranges of all remaining components of the telecommunications system.

18. The method of claim 14, wherein:

one or more of the components store the respective temperature ranges for the components in memory; and the remaining components are deemed to have a temperature range corresponding to a default temperature range.

19. A system, comprising:

a component engine operable to:

maintain a temperature range for each component of a telecommunications system, the temperature range indicating temperature conditions in which the component is suitable for operation; and determine an overall temperature range for the telecommunications system based on the temperature ratings of the components; and a network management system interfaced with the component engine operable to set an alarm in response to the component engine determining that there is no range of operating temperatures that falls within the temperature ranges of all of the components.

20. The system of claim 18, wherein the network management system is operable to provide the overall temperature range as output and further operable to provide notice whenever the network management system sets the alarm.

21. The system of claim 19, wherein the component engine is further operable to:

detect addition of a new component to the telecommunications system; and in response to detecting the addition of the new component, determine a temperature range for the new component.

22. The system of claim 19, wherein:

the component engine is further operable to:

detect removal of one of the components of the telecommunications system;

determine whether there is any range of operating temperatures that falls within the temperature ranges of all remaining components of the telecommunications system; and the network management system is further operable to clear the alarm if there is a range of operating temperatures that falls within the temperature ranges of all remaining components of the telecommunications system.

23. The system of claim 19, wherein:

one or more of the components store the respective temperature ratings for the components in memory; and the remaining components are deemed to have a temperature range corresponding to a default temperature range.

24. Software embodied in a computer-readable medium operable to perform the steps of:

maintaining ratings for each of a plurality of components in a telecommunications system, each rating comprising one of the following:

a controlled rating indicating that the component is intended for use in a controlled environment;

an uncontrolled rating indicating that the component is intended for use in an uncontrolled environment; or a both rating indicating the component is intended for use in either the controlled environment or the uncontrolled environment;

determining that an improper environmental configuration exists if the telecommunications system includes at least one component with a controlled rating and at least one other component with an uncontrolled rating; and setting an alarm if the improper environmental configuration exists.

25. The software of claim 24, further comprising:

detecting addition of a new component to the telecommunications system; and in response to detecting the addition of the new component, determining a rating for the new component.

26. The software of claim 24, further operable to perform the steps of:

detecting removal of one of the components of the telecommunications system;

re-determining whether the improper environmental configuration exists; and clearing the alarm if the improper environmental configuration no longer exists.

27. The software of claim 24, wherein:

the ratings are associated with a capability for operations in predetermined temperature environments;

the controlled environment comprises an indoor environment; and the uncontrolled environment comprises an outdoor environment.

28. The software of claim 24, wherein the step of determining the rating comprises:

downloading the rating from a flash memory of the new component; and if the component does not have a flash memory, assigning a both rating to the component.

29. Software embodied in a computer-readable medium operable to perform the steps of:

configuring telecommunications equipment comprising a plurality of components, each component having a rating comprising one of the following:

a controlled rating indicating that the component is intended for use in a controlled environment;

an uncontrolled rating indicating that the component is intended for use in an uncontrolled environment; or a both rating indicating the component is intended for use in either the controlled environment or the uncontrolled environment;

storing a component rating for one or more components in a memory associated with the one or more components;

detecting the rating for each component added to or removed from the telecommunications equipment;

determining that an improper environmental configuration exists if at least one component has a controlled rating and at least one other component has an uncontrolled rating;

setting an alarm if the improper environmental configuration exists; and clearing the alarm if an improper environmental configuration does not exist.

30. The software of claim 29, wherein:

storing the component rating comprises storing the component rating in a flash memory associated with the component; and detecting the rating comprises:

downloading the rating from the flash memory; and if the component has no flash memory, assigning a both rating to the component.

31. The software of claim 29, further operable to perform the steps of:

storing the rating for each added component in memory associated with the telecommunications equipment; and deleting the rating of each removed component from the memory associated with the telecommunications.

32. The software of claim 29, wherein:

the ratings are associated with a capability for operations in predetermined temperature environments;

the controlled environment comprises an indoor environment; and the uncontrolled environment comprises an outdoor environment.

33. A system, comprising:

means for configuring telecommunications equipment comprising a plurality of components, each component having a rating comprising one of the following:

a controlled rating indicating that the component is intended for use in a controlled environment;

an uncontrolled rating indicating that the component is intended for use in an uncontrolled environment; or a both rating indicating the component is intended for use in either the controlled environment or the uncontrolled environment;

means for storing a component rating for one or more components in a memory associated with the one or more components;

means for detecting the rating for each component added to or removed from the telecommunications equipment;

means for determining that an improper environmental configuration exists if at least one component has a controlled rating and at least one other component has an uncontrolled rating;

means for setting an alarm if the improper environmental configuration exists; and means for clearing the alarm if an improper environmental configuration no longer exists.

* * * * *